US010883334B2

(12) United States Patent
Gao et al.

(10) Patent No.: US 10,883,334 B2
(45) Date of Patent: Jan. 5, 2021

(54) MULTI-SEGMENTED PLUG

(71) Applicant: Halliburton Energy Services, Inc., Houston, TX (US)

(72) Inventors: Bo Gao, Spring, TX (US); Lonnie C. Helms, Humble, TX (US); David Li, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 45 days.

(21) Appl. No.: 15/769,714

(22) PCT Filed: Nov. 20, 2015

(86) PCT No.: PCT/US2015/061860
§ 371 (c)(1),
(2) Date: Apr. 19, 2018

(87) PCT Pub. No.: WO2017/086988
PCT Pub. Date: May 26, 2017

(65) Prior Publication Data

US 2018/0313185 A1 Nov. 1, 2018

(51) Int. Cl.

| | |
|---|---|
| ***E21B 33/128*** | (2006.01) |
| ***E21B 33/14*** | (2006.01) |
| ***E21B 23/14*** | (2006.01) |
| ***E21B 33/12*** | (2006.01) |

(52) U.S. Cl.
CPC ..... *E21B 33/1285* (2013.01); *E21B 33/12* (2013.01); *E21B 33/146* (2013.01)

(58) Field of Classification Search
CPC ..... E21B 23/14; E21B 33/146; E21B 33/14; E21B 33/128; E21B 33/1285
See application file for complete search history.

(56) References Cited

U.S. PATENT DOCUMENTS

| | | | | |
|---|---|---|---|---|
| 3,948,322 | A | 4/1976 | Baker | |
| 5,566,757 | A | 10/1996 | Carpenter et al. | |
| 5,762,139 | A | 6/1998 | Sullaway et al. | |
| 2007/0102158 | A1 | 5/2007 | Szarka | |
| 2010/0051276 | A1 | 3/2010 | Rogers | |
| 2015/0129212 | A1* | 5/2015 | Noe | E21B 43/267 166/280.2 |

FOREIGN PATENT DOCUMENTS

| | | |
|---|---|---|
| EP | 0225145 | 6/1987 |

OTHER PUBLICATIONS

International Search Report and Written Opinion of PCT Application No. PCT/US2015/061860 dated Aug. 18, 2016: pp. 1-10.

* cited by examiner

*Primary Examiner* — Catherine Loikith
(74) *Attorney, Agent, or Firm* — Chamberlain Hrdlicka

(57) ABSTRACT

A plug for use in a cementing operation in a borehole includes a tail segment and a nose segment separate from the tail segment. The plug also includes a coupler configured to couple the tail segment to the nose segment, in which the tail segment is movable with respect to the nose segment.

17 Claims, 7 Drawing Sheets

MULTI-SEGMENTED PLUG

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

In oil and gas industries, casing may be used to line a borehole or a portion of a borehole to maintain borehole integrity during drilling or production operations. Cement may be pumped through the casing and into an annulus between the casing and the borehole wall and allowed to set in order to hold casing in place. In some scenarios, cementing operations may be performed in two or more stages where casing is placed within a borehole and a portion of the casing is cemented. Thereafter, a second (or more) cementing operation is performed to cement the remaining portion (s) of the casing into place.

BRIEF DESCRIPTION OF DRAWINGS

For a detailed description of the embodiments of the invention, reference will now be made to the accompanying drawings in which.

DETAILED DESCRIPTION

Figure 1:
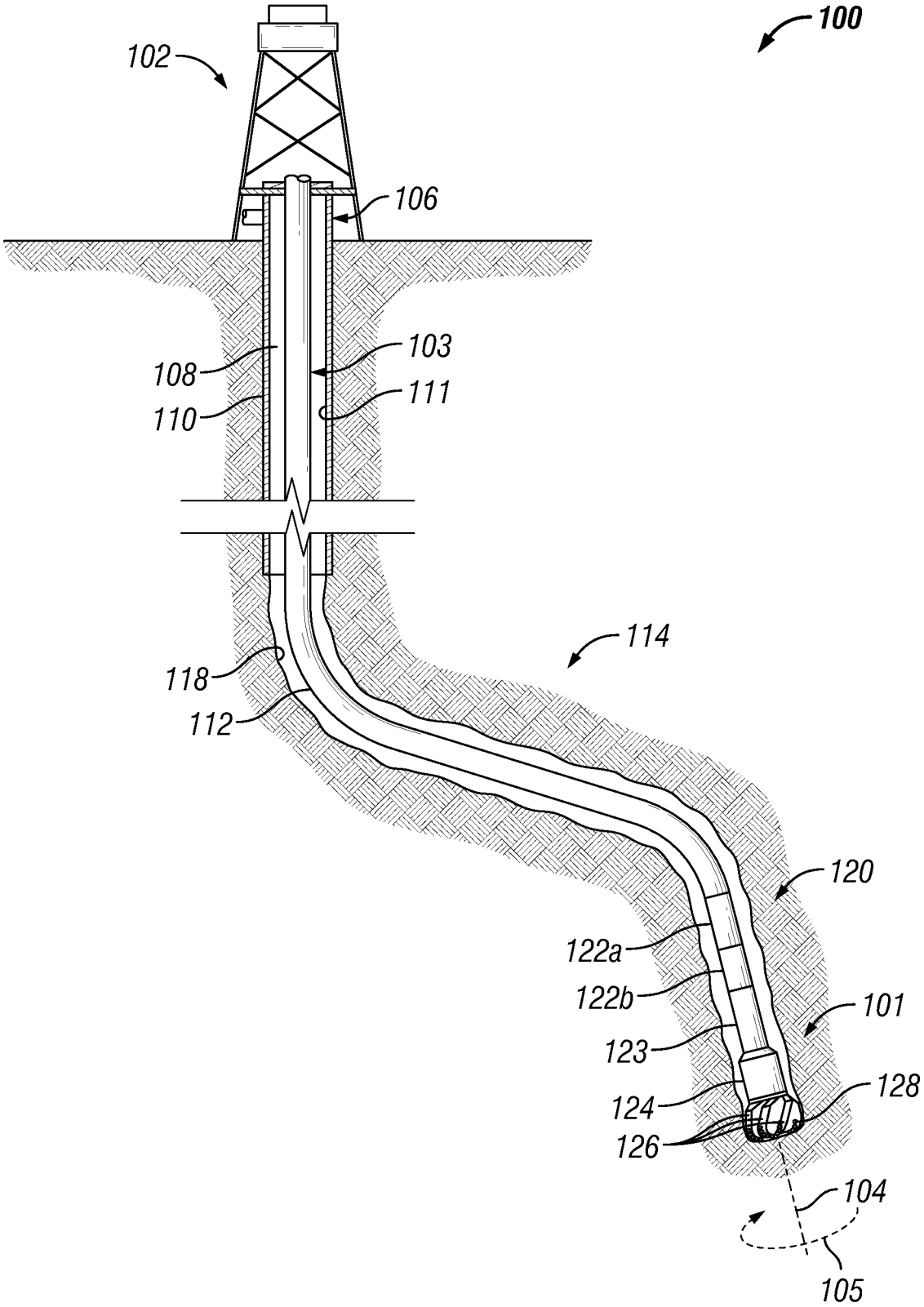
FIG. 1 depicts a schematic representation of an example well being drilled by a directional drilling system in accordance with one or more embodiments.

Referring now to the present figures, FIG. 1 depicts a borehole 114 being drilled by a drilling system 100, in accordance with example embodiments of the present disclosure. Various types of drilling equipment such as a rotary table, drilling fluid pumps and drilling fluid tanks (not expressly shown) may be located at a well site 106. For example, the well site 106 may include a drilling rig 102 that has various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

The drilling system 100 may also include a drill string 103 associated with a drill bit 101 that may be used to form a wide variety of wellbores or boreholes such as generally diagonal or directional borehole 114. The term "directional drilling" may be used to describe drilling a wellbore or portions of a wellbore that extend at a desired angle or angles relative to vertical. The desired angles may be greater than normal variations associated with vertical wellbores. Directional drilling may be used to access multiple target reservoirs within a single borehole 114 or reach a reservoir that may be inaccessible via a vertical wellbore. As an example of a directional drilling system, FIG. 1 depicts a rotary steerable system (RSS) 123 that may be used to perform directional drilling. The RSS 123 may use a point-the-bit method to cause the direction of the drill bit 101 to vary relative to the housing of the rotary steerable drilling system 123 by bending a shaft running through the rotary steerable drilling system 123.

The drilling system 100 may also include a bottom hole assembly (BHA) 120. The BHA 120 may include a wide variety of components, such as components 122*a* and 122*b*, configured to form the borehole 114. Such components may include, but are not limited to, drill bits (e.g., the drill bit 101), coring bits, drill collars, rotary steering tools (e.g., the RSS 123) or other directional drilling tools, downhole drilling motors, reamers, hole enlargers or stabilizers. The number and types of components included in the BHA 120 may depend on anticipated downhole drilling conditions and the type of wellbore that is to be formed. The BHA 120 may also include various types of well logging tools and other downhole tools associated with directional drilling of a wellbore such as so-called measurement-while-drilling (MWD) or logging-while-drilling (LWD) tools. Examples of logging tools and/or directional drilling tools may include, but are not limited to, acoustic, neutron, gamma ray, density, photoelectric, nuclear magnetic resonance, rotary steering tools and/or any other available well tool. Further, the BHA 120 may also include a rotary drive (not expressly shown) that rotates at least part of the drill string 103 together with components 122*a* and/or 122*b*.

The drill bit 101 may include one or more blades 126 disposed outwardly from exterior portions of a rotary bit body 124. The blades 126 may be any suitable type of projections extending outwardly from the rotary bit body 124. The drill bit 101 may rotate with respect to a bit rotational axis 104 in a direction defined by directional arrow 105. The blades 126 may include one or more cutting elements 128 disposed outwardly from exterior portions of each blade 126. The blades 126 may also include one or more depth of cut controllers (not expressly shown) configured to control the depth of cut of the cutting elements 128. The blades 126 may further include one or more gage pads (not expressly shown) disposed on blades 126. The drill bit 101 may be designed and formed in accordance with teachings of the present disclosure and may have many different designs, configurations, and/or dimensions according to the particular application of the drill bit 101.

Various types of drilling fluid may be pumped from the surface of the well site 106 downhole through the drill string 103 to the attached drill bit 101. The drilling fluids may be directed to flow from the drill string 103 to respective nozzles passing through the drill bit 101. The drilling fluid may be circulated uphole to the well surface 106 through an annulus 108 surrounding the drill string 103.

The borehole 114 may be defined in part by a casing string 110 extending from the surface of the well site 106 to a selected downhole location. Portions of the borehole 114 that do not include the casing string 110 may be described as "open hole," while portions of the borehole 114 that include the casing string 110 may be referred to as a "cased hole." In open hole sections, the annulus 108 may be defined in part by an outside diameter 112 of the drill string 103 and an inside diameter 118 of the borehole 114. In cased hole sections, the annulus 108 may be defined by an outside diameter 112 of the drill string 103 and an inside diameter 111 of the casing string 110.

To case the borehole 114, casing string 110 is run into the borehole 114 (e.g., using a running tool) and hung on a casing hanger (not shown). Cement is pumped through the casing string 110 and into the annulus 108 between the casing string 110 and the borehole wall 118 (or a previously run casing string) in order to cement the casing string 110 into place. In one or more embodiments, the cementing process may be done in stages in which multiple sections of cement are pumped behind the same casing string. For example, when a casing string 110 is too long to cement by only pumping cement into the annulus from a distal end of the casing string 110, a multi-stage cementing operation may be performed. To avoid drilling through the casing string 110 and cement at that location, a first stage of a multi-stage cementing operation may be performed to cement the portion of the casing string 110 below the predetermined location and a second stage of a multi-stage cementing operation may be performed to cement the casing string 110 above the predetermined location.

Figure 2A:
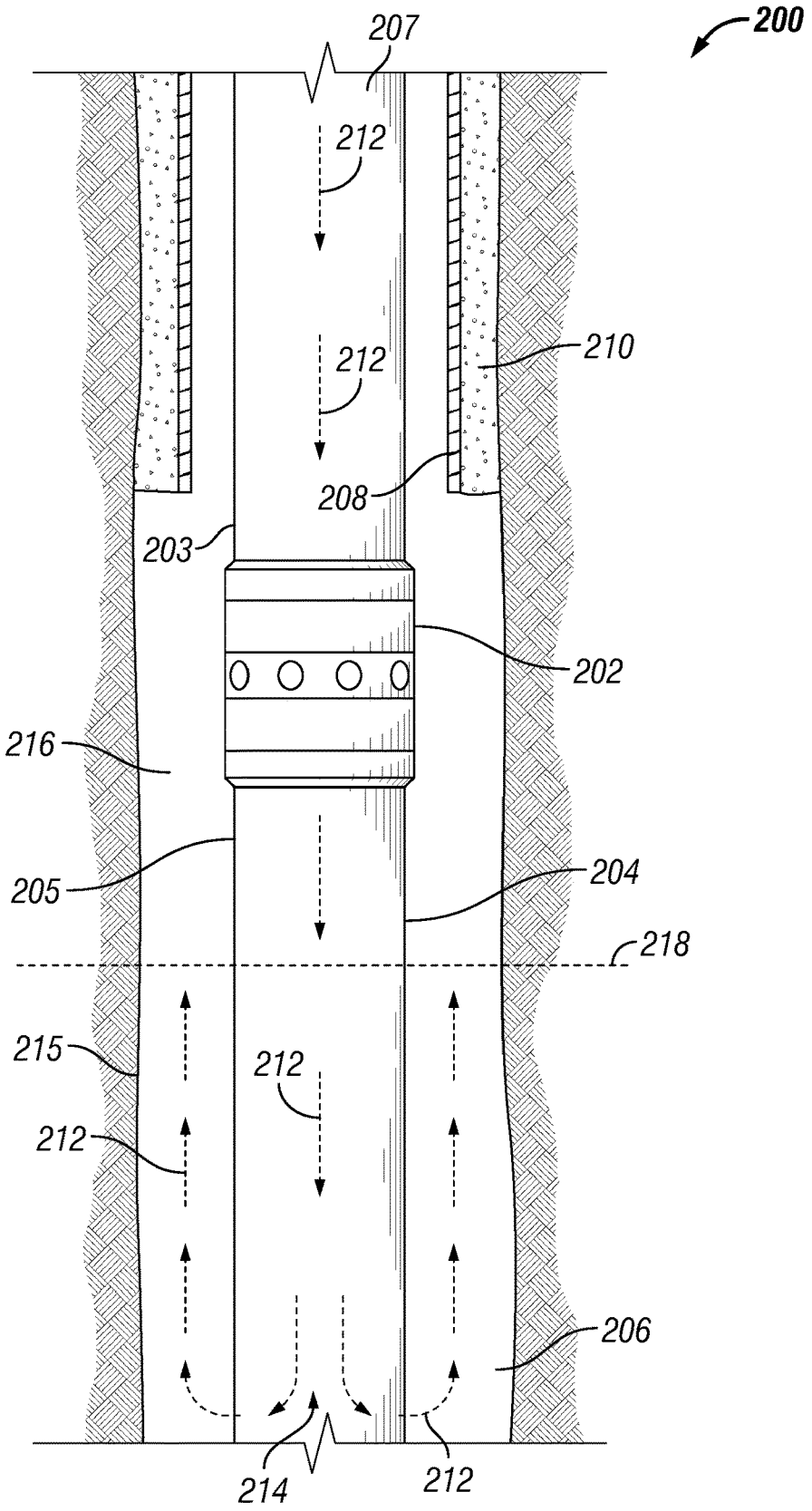
FIGS. 2A-2D depict schematic cross-sectional views of a system for performing a multi-stage cementing operation in accordance with one or more embodiments.

FIG. 2A depicts a system for performing a multi-stage cementing operation in accordance with one or more embodiments. The system 200 includes a stage tool 202 interconnected in a casing string 204 having an upper casing portion 203 and a lower casing portion 205, the upper casing portion 203 being located above the stage tool 202 and the lower casing portion 205 being located below the stage tool 202. The stage tool 202 may be interconnected in the casing string 204 at a location determined based on the operation, borehole conditions, operating equipment, and/or predetermined well plans, among other factors, and may be used to perform a multi-stage cementing operation in which a first stage of cementing is performed followed by one or more additional stages of cementing.

As shown, the casing string 204 is run into a borehole 206 that includes a previously run casing string 208 which was cemented into place using cement 210. The casing string 204 may be run into the borehole 206 using a running tool (not shown) connected to a rig, such as drilling rig 102 in FIG. 1, and/or other operating equipment known in the art.

Once the casing string 204 is run into the borehole 206, a first stage of a multi-stage cementing process may be performed. Cement is pumped along a flow path through a bore 207 inside of the casing string 204 and the stage tool 202 as indicated by arrows 212 and out a distal end 214 of the casing string 204. Cement slurry may then flow into an annulus 216 between the casing string 214 and a borehole wall 215 and uphole along a length of the casing string 214. Pumping may be stopped when the cement slurry reaches a predetermined depth 218 along the length of the casing string 214. In one or more embodiments, the predetermined depth 218 may be determined based on the total length of the casing string 204, borehole conditions, operating equipment, and/or predetermined well plans, among other factors. It should be understood that the predetermined depth 218 may be at any location along the length of the casing string 204 and may extend into the annulus 216 between the casing string 204 and the previously run casing string 208. In addition, although not shown, it should be understood that other equipment such as guide shoes, float collars, flapper valves, stage plugs, and the like, may be included and used in the multi-stage cementing process without departing from the scope of the present disclosure.

Figure 2B:
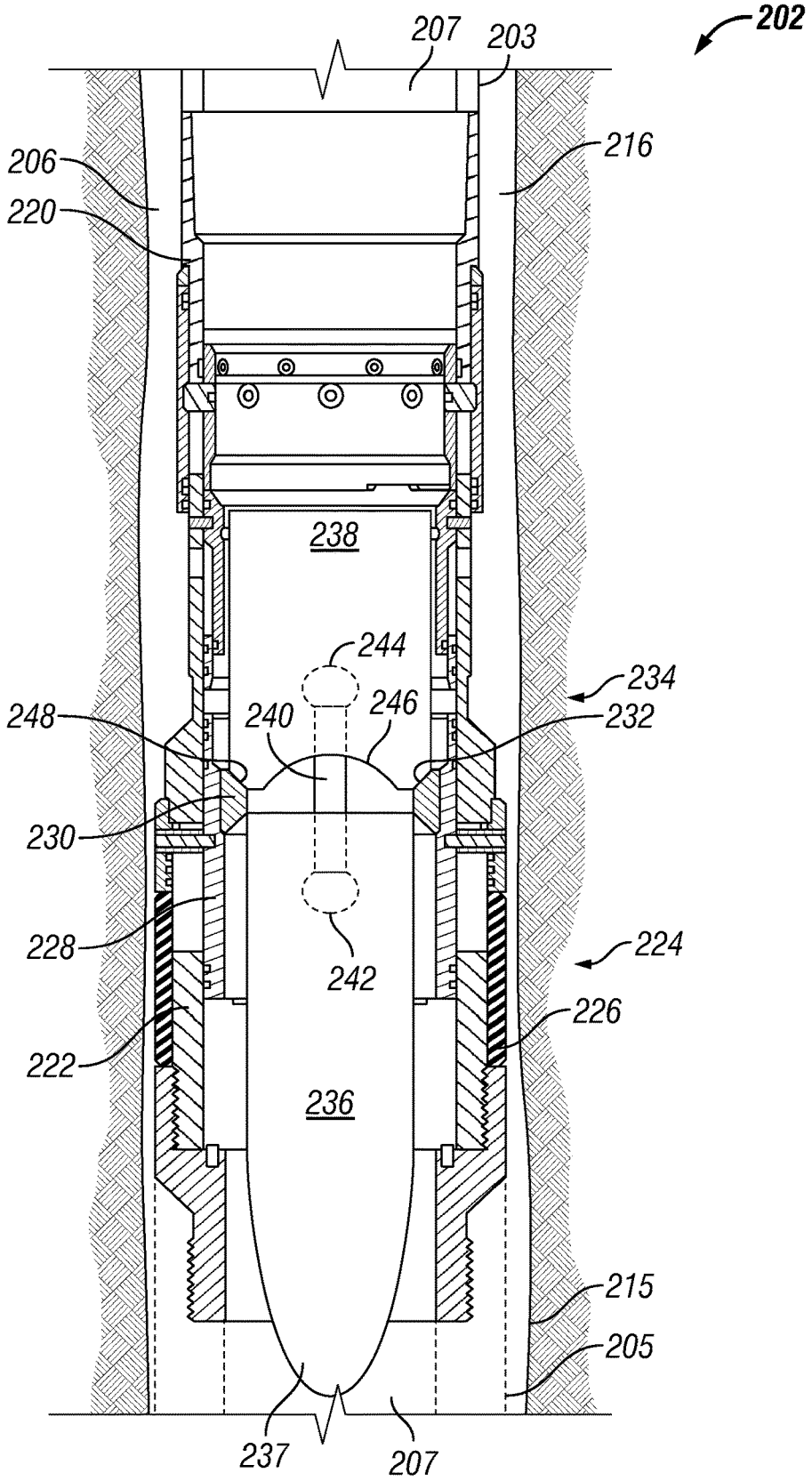
Figure 2C:
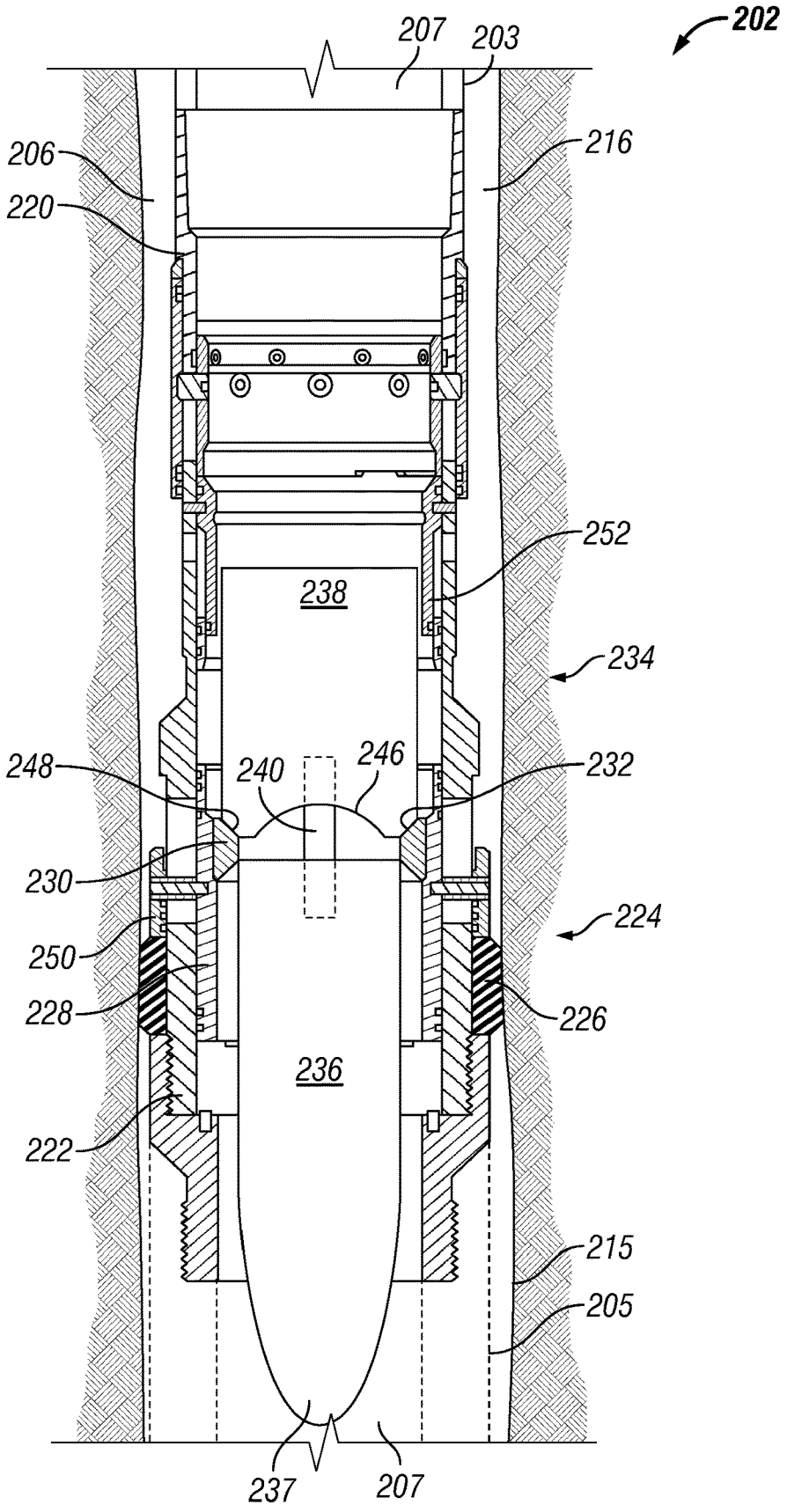
Figure 2D:
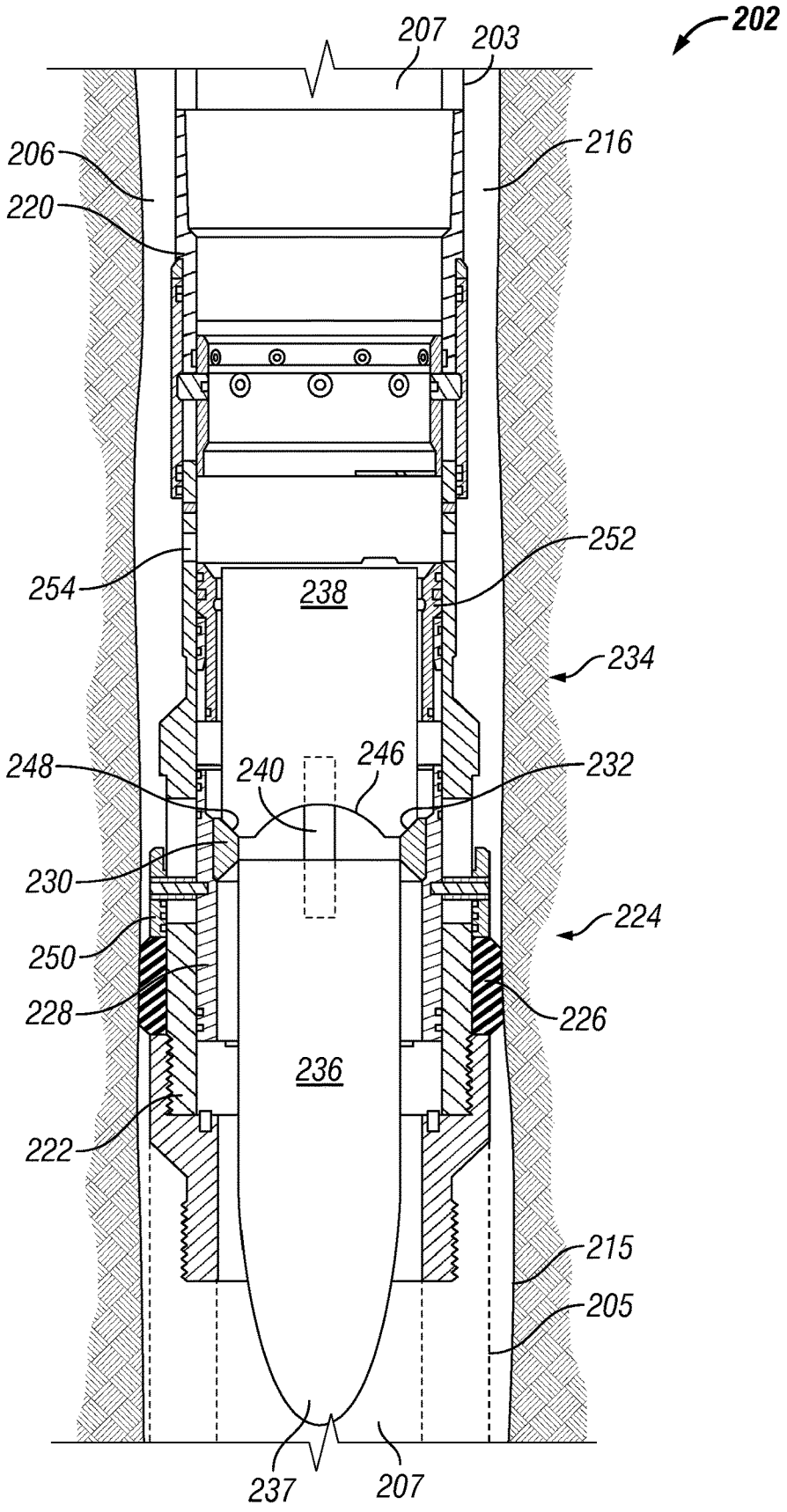

FIGS. 2B-2D depict the stage tool 202 interconnected in the casing string 204 configured to perform a multi-stage cementing operation in accordance with one or more embodiments. As shown, the stage tool 202 includes an upper housing 220 and a lower housing 222 that are coupled to upper casing portion 203 and lower casing portion 205, respectively. The stage tool 202 may optionally include a packer assembly 224 having an expandable packer element 226, as shown. The expandable packer element 226 may comprise a compressible and/or inflatable packer material, an elastomeric material, an expandable bladder, or any other packer material known in the art. The packer assembly 224 also includes a sliding sleeve 228 configured to engage with a set collar 230. The sliding sleeve 228 is configured to slide axially with respect to the stage tool 202 and packer assembly 224. The set collar 230 includes a profiled edge 232 configured to engage with a cement plug, such as multi-segmented plug 234, as described further below.

In one or more embodiments, the multi-segmented plug 234 includes a nose segment 236 and a tail segment 238. The nose segment 236 may include a convex, rounded, or pointed shaped nose 237 configured to guide the multi-segmented plug 234 when positioned within the casing string 204. In one or more embodiments, the multi-segmented plug 234 may positioned using a free fall technique, where the plug 234 is allowed to fall using the force of gravity from one location within the borehole to another. In some embodiments, the plug 234 may be conveyed into position using a cable, coiled tubing, running tool, or any other conveying device and/or method known in the art.

In one or more embodiments, the nose segment 236 may be made of a material different from the tail segment 238 and may include a weighted material and/or multiple weights (e.g., heavy-weighted marbles, lead shots, etc.) used to control the speed in which the multi-segmented plug 234 falls within the casing string 204. The nose segment 236 may be separable from the tail segment 238, but capable of coupling to the tail segment 238 using a coupler 240, as shown.

The coupler 240 may extend longitudinally along at least a portion of a length of the nose segment 236 and/or may extend about a circumference of the nose segment 236. In one or more embodiments, the coupler 240 may extend at least partially within the nose segment 236. The coupler 240 may be movably coupled to the nose segment 236 such that the nose segment 236 is movable relative to the tail segment 238, the coupler 240, or both. In one or more embodiments, the coupler 240 may be threaded into a section of the nose segment 236 that is rotatable, displaceable, or otherwise movable with respect to the rest of the nose segment 236. For example, the coupler 240 may be threaded into a ball section 242 of the coupler 240 such that the coupler 240 is capable of moving with respect to the nose segment 236.

As mentioned above, the coupler 240 may be coupled to the tail segment 238. The coupler 240 may extend longitudinally along at least a portion of a length of the tail segment 238 and/or may extend about a circumference of the tail segment 238. In one or more embodiments, the coupler 240 may extend at least partially within the tail segment 238. The coupler 240 may be movably coupled to the tail segment 238 such that the tail segment 238 is movable relative to the nose segment 236, the coupler 240, or both. In one or more embodiments, the coupler 240 may be threaded into a section of the tail segment 238 that is rotatable, displaceable, or otherwise movable with respect to the rest of the tail segment 238. For example, the coupler 240 may be threaded into a ball section 244 of the coupler 240 such that the coupler 240 is capable of moving with respect to the tail segment 238. In another example, the coupler 240 may formed of an elastomeric flexible material which allows for movement between the tail segment 238 and the nose segment 236 when the coupler 240 flexes. Optionally, the nose segment 236, the tail segment 238, and the coupler 240 may form a single body (not shown). The single body may be formed of an elastomeric material such that the tail segment 238 and the nose segment 236 may be movable with respect to each other as portions of the single body (e.g., the coupler 240) flexes.

The tail segment 238 may include a lower section 246 having a shoulder 248. The shoulder 248 may be inclined, slanted, or otherwise profiled and configured to engage with the edge profile 232 of the set collar 230. The tail segment 238 may also include and/or be formed of an elastomeric to create a hydraulic seal. The lower section 246 may include a portion that is concaved and/or curved to reduce the tensile stress within the tail segment 238 caused by the engagement of the shoulder 248 with the edge profile 232 of the set collar 230. It should be understood that other shapes may form the lower section 246 of the tail segment 238 in order to reduce mechanical stress within the tail segment without departing from the scope of the present disclosure.

In one or more embodiments, the coupler 240 may be formed of a material different from the nose segment 236 and/or the tail segment 238. The tail segment 238 may be formed from a material different than the nose segment 236. In one or more embodiments, at least one of the nose segment 236, the tail segment 238, and the coupler 240 may be formed of a resin, such as carbon fiber reinforced resin or a resin that provides sufficient reinforcement to shift sleeves of a cementer. In one or more embodiments, at least one of the nose segments 236, the tail segment 238, and the coupler 240 of the multi-segmented plug 234 may be formed of at least one of aluminum, lead, steel, or a composite material as known in the art.

The nose segment 236 may be formed of or may comprise a particular material based on the weight of the material in order to control a speed in which the plug 234 is guided in the borehole 206. For example, the nose segment 236 may be formed from a heavy metal allowing for a faster speed when the plug 234 is guided in the borehole 206. The nose segment 236 may be formed of a lightweight elastomeric material allowing for a slower speed when the plug 234 is guided in the borehole 206. Similarly, the tail segment 238 may also be formed of different materials to control the speed in which the plug 234 is positioned, or otherwise guided, in the borehole 206.

After the first cementing stage is completed, the multi-segmented plug 234 may be dropped within the bore 207 of the casing string 204 and allowed to free fall within the casing string 204. As described further below, the multi-segmented plug 234 is configured to land within the stage tool 202, seal off the bore 207 of the lower casing portion 205, and set the stage tool 202 prior to beginning the second stage of a multi-stage cementing operation.

Once the multi-segmented plug 234 lands within the stage tool 202, as shown in FIG. 2B, pressure may be applied to the tail segment 238 of the multi-segmented plug 234. The applied pressure may be fluid pressure from drilling mud, injection fluid, or the like. In one or more embodiments, the applied pressure may be from equipment, such as a setting tool (not shown) or a hydraulic piston, configured to apply a force directly or indirectly to the tail segment 238. As pressure is applied to the tail segment 238, the shoulder 248 of the tail segment 238 pushes on the set collar 230 and may cause the set collar 230 to move. Movement of the set collar 230 causes a housing ring 250 to compress and expand the packer element 226 of the packer assembly 224, as shown in FIG. 2C. The expanded packer element 226 expands into engagement with the borehole wall 215 (or a previously run casing string, such as casing string 208 as shown in FIG. 2A) to set the stage tool 202 and seal the annulus 216 between the lower casing portion 205 and the borehole wall 215.

After expansion of the packer element 226, the stage tool 202 is set and ready to begin a second stage in the multi-stage cementing process. Pressure may be applied, using an actuating tool for example (not shown), to actuate a stage sleeve 252 of the stage tool 202 causing the stage sleeve 252 to move downward to expose ports 254 of the stage tool 202, as shown in FIG. 2D. The pressure acts across the plug 234 which drives the stage sleeve 252 to an open position. As is understood, this movement may cause setting of a packer and/or opening up of ports to inflate a packer. At this point, a second cement process may be performed by pumping cement through the bore 207 of the upper casing portion 203, through ports 254 of the stage tool 202, and into the annulus 216 between the upper casing portion 203 and the borehole wall 215.

In multi-stage cementing operations, two or more stage tools (such as stage tool 202) may be used to cement the casing string 204 within the borehole 206. In one or more embodiments, after each stage, cement may be allowed to harden before proceeding with the next stage. Alternatively, as shown in FIGS. 2A-2D, n annulus may be sealed off from the annulus to be cemented in the next stage so that the next stage of cementing may be performed prior to complete hardening of the cement of at least one of the previous stages.

Figure 3:
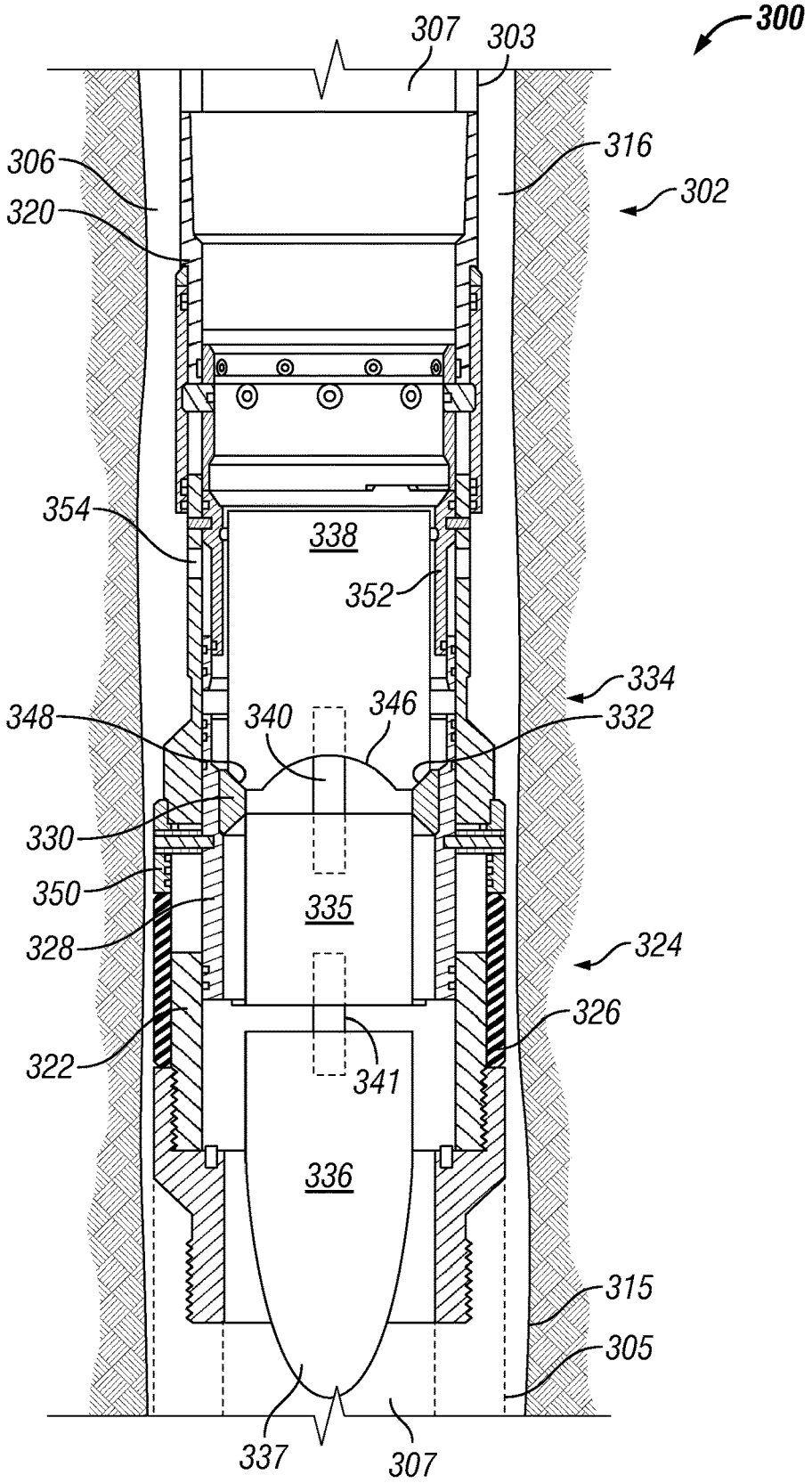
FIG. 3 depicts a schematic cross-sectional view of a system including a stage tool interconnected in a casing string in accordance with one or more embodiments.

FIG. 3 depicts a system 300 including a stage tool 302 within a borehole 306. The staging tool 302 is interconnected in a casing string 304 configured to perform a multi-stage cementing operation in accordance with one or more embodiments. As above, the stage tool 302 includes an upper housing 320 and a lower housing 322 adapted to be coupled to upper casing portion 303 and lower casing portion 305, respectively. The stage tool 302 also includes a packer assembly 324 having an expandable packer element 326. The expandable packer element 226 may comprise a compressible and/or inflatable packer material, an elastomeric material, an expandable bladder, or any other packer material known in the art. The packer assembly 324 also includes a sliding sleeve 328 configured to engage with a set collar 330 and configured to slide axially with respect to the stage tool 302 and packer assembly 324. The set collar 330 includes a profiled edge 332 configured to engage with a cement plug, such as multi-segmented plug 334, as described further below.

In one or more embodiments, the multi-segmented plug 334 includes a nose segment 336 separable from a tail segment 338. The nose segment 336 may include a guide nose 337, as described above and may be made of a material different from the tail segment 338. The nose segment 336 may include a weighted material and/or multiple weights (e.g., heavy-weighted marbles, lead shots, etc.) used to control the speed in which the multi-segmented plug 334 falls. The nose segment 336 may be coupled to the tail segment 338 through a middle segment 335. The middle segment 335 may be coupled to the tail segment 338 and the nose segment 336 using coupler 340 and coupler 341, respectively.

Similar to the above, the couplers 340, 341 may extend longitudinally along, within, and/or about at least a portion of the tail segment 338, the nose segment 336 and the middle segment 335. The couplers 340, 341 may be configured to move with respect to at least one of the tail segment 338, the nose segment 336 and the middle segment 335 such that the nose segment 336 is movable relative to the tail segment 338, the middle segment 335, and the couplers 340, 341 or any combination of the foregoing.

The tail segment 338 may include a lower section 346 having a shoulder 348. The shoulder 348 may be inclined, slanted, or otherwise profiled and configured to engage with the edge profile 332 of the set collar 330. The lower section 346 may be concaved and/or curved to reduce the tensile stress within the tail segment 338 caused by the engagement of the shoulder 348 with the edge profile 332 of the set collar 330. It should be understood that other shapes may form the lower section 346 of the tail segment 338 in order to reduce tensile stress within the tail segment without departing from the scope of the present disclosure.

As above, the tail segment 338, the nose segment 336 and the middle segment 335, as well as the couplers 340, 341 may be formed from the same or different material. For example, at least one of the tail segment 338, the nose segment 336 and the middle segment 335 as well as the couplers 340, 341 may be formed of a resin, such as a carbon fiber reinforced resin and/or a resin formed of at least one of aluminum, lead, steel, or a composite material as known in the art.

As shown, the multi-segmented plug 334 may be configured to land within the stage tool 302 and used to seal off the bore 307 of the lower casing portion 305 and set the stage tool 302 prior to beginning the second stage of a multi-stage cementing operation. Similar to the multi-stage cementing process described in FIGS. 2A-2D, the multi-segmented plug 334 lands within the stage tool 302 and pressure may be applied to the tail segment 338 of the multi-segmented plug 334. The applied pressure may be fluid pressure from drilling mud, injection fluid, or the like. In one or more embodiments, the applied pressure may be from equipment, such as a setting tool (not shown) or a hydraulic piston, configured to apply a force directly or indirectly to the tail segment 338. In one or more embodiments, a load may be optionally transmitted to the tail segment 338. As pressure is applied to the tail segment 338, the shoulder 348 of the tail segment 338 pushes on the set collar 330 and may cause the set collar 330 to move causing a housing ring 350 to move and expand the packer element 326 of the packer assembly 324 into engagement with the borehole wall 315 (or a previously run casing string).

After expansion of the packer element 326, the stage tool 302 is set and pressure may be applied, using an actuating tool for example (not shown) to actuate a stage sleeve 352 to expose ports 354 of the stage tool 302. Cement may then be pumped through the bore 307 of the upper casing portion 303 through ports 354 of the stage tool 302 and into the annulus 316 between the upper casing portion 303 and the borehole wall 315.

In multi-stage cementing operations, two or more stage tools may be used and in one or more embodiments, after each stage, cement may be allowed to harden before proceeding with the next stage. Alternatively, similar to FIGS. 2A-2D, an annulus may be sealed off from the annulus to be cemented in the next stage so that the next stage of cementing may be performed prior to complete hardening of the cement of at least one of the previous stages.

Figure 4:
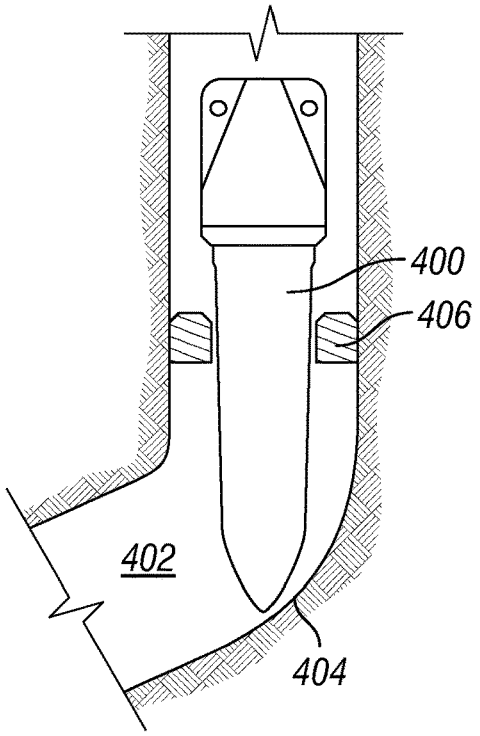
FIG. 4 depicts a cross-sectional view of a single body plug in accordance with one or more embodiments.

In accordance with one or more embodiments, a system for performing a multi-stage cementing process may be performed using a multi-segmented plug. As a nose segment and a tail segment of the multi-segmented plug are movable with respect to each other, the multi-segmented plug may be used in deviated boreholes where single body plugs would be incapable of operating. For example, as shown in FIG. 4, a single body plug 400 is shown in a deviated borehole 402. When the angle of deviation exceeds a certain amount in a deviated borehole, the single body plug 400 may contact the casing 404 prior to engaging with a stage collar 406 (or any component known in the art). Thus, the single body plug 400 may not be capable of performing any sealing, engaging, and/or setting, in a multi-stage cementing process.

Figure 5:
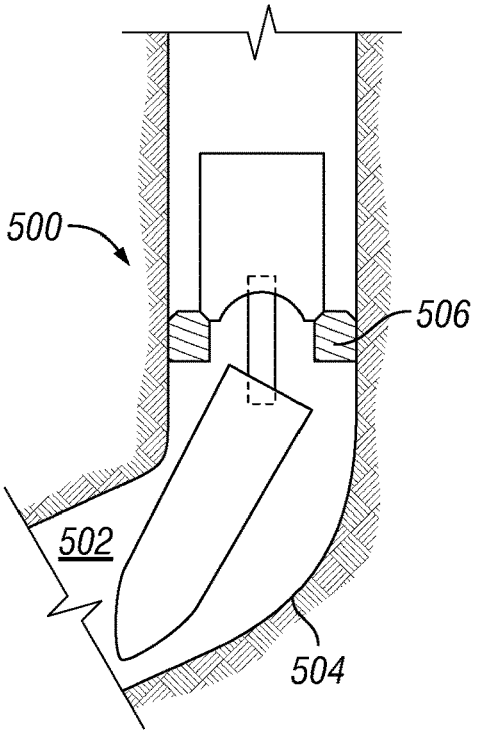
FIG. 5 depicts a cross-sectional view of a multi-segmented plug in accordance with one or more embodiments.

Alternatively, as shown in FIG. 5, a multi-segmented plug 500 is capable of properly engaging with a stage collar 506 (or any other component known in the art) when used in a multi-stage cementing process within a deviated well 502 without contacting the casing 504.

Additionally, it should be understood that although the above example systems and methods depict a plug for use in a multi-stage cementing operation, a plug in accordance with one or more embodiments may be used in a single stage cementing operation or any other operation known in the art.

In accordance with one or more embodiments, a multi-segmented plug may be utilized to move an internal sleeve (e.g., to expose downhole pressure chambers, move magnetic switches to begin a timing operation, open ports to allow a chemical to be pumped/released to perform a specific function). A multi-segmented plug in accordance with one or more embodiments may be used to provide a surface pressure indication that a given downhole event has occurred (e.g., observed as a pressure drop or ability to displace fluids into the casing).

In addition to the embodiments described above, many examples of specific combinations are within the scope of the disclosure, some of which are detailed below:

EXAMPLE 1

A plug for use in a cementing operation in a borehole, the plug comprising: a tail segment; a nose segment separate from the tail segment; a coupler configured to couple the tail segment to the nose segment, wherein the coupler is movable with respect to at least one of the nose segment and the tail segment, and wherein the tail segment is movable with respect to the nose segment.

EXAMPLE 2

The plug of example 1, wherein the tail segment comprises a concave lower portion and a shoulder configured to engage with a downhole component.

EXAMPLE 3

The plug of example 1, wherein the nose segment comprises a convex guiding nose configured to guide the plug within the borehole.

EXAMPLE 4

The plug of example 1, wherein at least one of the tail segment, the coupler, and the nose segment is formed from a resin.

EXAMPLE 5

The plug of example 1, wherein the nose segment is formed from a material different from at least one of the tail segment and the coupler.

EXAMPLE 6

The plug of example 1, wherein the nose segment comprises weighting materials configured to control a speed in which the plug falls within the borehole.

EXAMPLE 7

The plug of claim 1, wherein the tail segment is movable with respect to the nose segment when the coupler is formed form an elastomer material.

EXAMPLE 8

The plug of example 1, further comprising a middle segment coupled between the nose segment and the tail segment and movable with respect to at least one of the nose segment and the tail segment.

EXAMPLE 9

The plug of example 1, wherein the plug comprises a free-fall plug configured to engage a sleeve of a multi-stage cementing tool.

EXAMPLE 10

The plug of example 1, wherein the coupler is coupled to at least one of a ball section of the nose segment and a ball section of the tail segment.

EXAMPLE 11

The plug of example 10, wherein the coupler is configured to move relative to at least one of the nose segment and the tail segment.

EXAMPLE 12

A system for performing a multi-stage cementing operation in a borehole having a borehole wall, the system comprising: a casing string comprising: an upper portion; a lower portion; and a stage tool coupled between the upper portion and the lower portion. The system further comprising a multi-segmented plug comprising a tail segment movably coupled to a nose segment and configured to land within the stage tool.

EXAMPLE 13

The system of example 12, wherein the stage tool comprises a packer assembly configured to seal an annulus between the casing string and the borehole wall.

EXAMPLE 14

The system of example 12, wherein a coupler movably couples the nose segment and the tail segment,

EXAMPLE 15

The system of example 12, further comprising a coupler movable relative to at least one of the nose segment and the tail segment.

EXAMPLE 16

The system of example 12, wherein at least one of the nose segment, the tail segment, and the coupler is made from a resin.

EXAMPLE 17

A method of performing a multi-stage cementing operation in a borehole, the method comprising: running a stage tool connected between an upper portion and a lower portion of a casing string, landing the casing string at a particular depth within the borehole, pumping first stage cement through the casing string and the stage tool and into an annulus between the casing string and a borehole wall. The method comprising setting a packer assembly of the stage tool by landing a multi-segmented plug within the stage tool. The method further comprising pumping second stage cement through the upper portion of the casing string and into the annulus through ports within the stage tool.

EXAMPLE 18

The method of example 17, wherein setting the packer assembly comprises moving a sleeve of the packer assembly to expand a packer element.

EXAMPLE 19

The method of example 18, wherein moving a sleeve of the packer assembly comprises applying pressure to a tail segment of the multi-segmented plug engaged with a set collar of the packer assembly.

EXAMPLE 20

The method of example 17, further comprising allowing the first stage cement to harden before pumping the second stage cement.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple"

or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

We claim:

1. A plug for use in a cementing operation in a borehole, the plug comprising:

a tail segment comprising a concave lower portion and a shoulder configured to contact and engage with a downhole component that is separate from the plug;

a nose segment separate from the tail segment; and a coupler configured to couple the tail segment to the nose segment, wherein the coupler is movable with respect to at least one of the nose segment and the tail segment, and wherein the tail segment is movable with respect to the nose segment.

2. The plug of claim 1, wherein the nose segment comprises a convex guiding nose configured to guide the plug within the borehole.

3. The plug of claim 1, wherein at least one of the tail segment, the coupler, and the nose segment is formed from a resin.

4. The plug of claim 1, wherein the nose segment is formed from a material different from at least one of the tail segment and the coupler.

5. The plug of claim 1, wherein the nose segment comprises weighting materials configured to control a speed in which the plug falls within the borehole.

6. The plug of claim 1, wherein the tail segment is movable with respect to the nose segment when the coupler is formed form an elastomer material.

7. The plug of claim 1, further comprising a middle segment coupled between the nose segment and the tail segment and movable with respect to at least one of the nose segment and the tail segment.

8. The plug of claim 1, wherein the plug comprises a free-fall plug configured to engage a sleeve of a multi-stage cementing tool.

9. The plug of claim 1, wherein the coupler is coupled to at least one of a ball section of the nose segment and a ball section of the tail segment.

10. The plug of claim 9, wherein the coupler is configured to move relative to at least one of the nose segment and the tail segment.

11. A system for performing a multi-stage cementing operation in a borehole having a borehole wall, the system comprising:

a casing string comprising:

an upper portion;

a lower portion; and a stage tool coupled between the upper portion and the lower portion; and a multi-segmented plug comprising a tail segment movably coupled to a nose segment and configured to land within the stage tool, the tail segment configured to contact and engage with the stage tool.

12. The system of claim 11, wherein the stage tool comprises a packer assembly configured to seal an annulus between the casing string and the borehole wall.

13. The system of claim 11, wherein a coupler movably couples the nose segment and the tail segment.

14. The system of claim 11, further comprising a coupler movable relative to at least one of the nose segment and the tail segment.

15. The system of claim 14, wherein at least one of the nose segment, the tail segment, and the coupler is made from a resin.

16. A method of performing a multi-stage cementing operation in a borehole, the method comprising:

running a stage tool connected between an upper portion and a lower portion of a casing string;

landing the casing string at a particular depth within the borehole;

pumping first stage cement through the casing string and the stage tool and into an annulus between the casing string and a borehole wall;

moving a sleeve of a packer assembly of the stage tool to set the packer assembly by landing a multi-segmented plug within the stage tool and applying pressure to a tail segment of the multi-segmented plug, the tail segment engaged with a set collar of the packer assembly; and pumping second stage cement through the upper portion of the casing string and into the annulus through ports within the stage tool.

17. The method of claim 16, further comprising allowing the first stage cement to harden before pumping the second stage cement.

* * * * *